US006014818A

United States Patent [19]

Kriström

[11] Patent Number: 6,014,818

[45] Date of Patent: Jan. 18, 2000

[54] DRYING APPARATUS HAVING A FRAME DEVICE FOR MOUNTING JET BOXES

[76] Inventor: Sture Kriström, Babordsv 19, S-865 31 Alnö, Sweden

[21] Appl. No.: 08/875,116

[22] PCT Filed: Jan. 22, 1996

[86] PCT No.: PCT/SE96/00057

§ 371 Date: Sep. 15, 1997

§ 102(e) Date: Sep. 15, 1997

[87] PCT Pub. No.: WO96/22419

PCT Pub. Date: Jul. 25, 1996

[30] Foreign Application Priority Data

Jan. 20, 1995 [SE] Sweden ..... 9500196

[51] Int. Cl.[7] ..... F26B 23/10

[52] U.S. Cl. ..... 34/273; 34/444; 34/451; 162/207

[58] Field of Search ..... 162/63, 207; 34/443, 34/444, 451, 452, 425, 428, 518, 239, 511

[56] References Cited

U.S. PATENT DOCUMENTS 3,634,948 1/1972 Kobayashi ..... 34/156
3,851,407 12/1974 Rantala ..... 34/155

*Primary Examiner*—Dean T. Nguyen
*Attorney, Agent, or Firm*—Pillsbury Madison & Sutro LLP

[57] ABSTRACT

Apparatus for drying a pulp web includes a plurality of jet boxes, arranged vertically in piles parallel with each other, and provided with openings through which heated air, introduced into the jet boxes, can stream out. The pulp web is conducted in an essentially vertical direction between the piles of adjacent jet boxes and around upper and lower turning rolls for bringing the pulp web upwards and downwards through the apparatus; heating air streaming out of holes in the jet boxes towards the progressing pulp web; irradiating essentially all that portion of the pulp web which momentarily is between the upper and the lower turning rolls, on both sides with the heated air.

6 Claims, 4 Drawing Sheets

DRYING APPARATUS HAVING A FRAME DEVICE FOR MOUNTING JET BOXES

FIELD OF THE INVENTION

This invention relates to a method for drying a pulp web, using an apparatus having a great number of jet boxes arranged in piles positioned parallel with each other, and provided with openings through which the heated air, coming into the jet boxes, can stream out.

The invention also relates to a drying apparatus for carrying out the above method.

BACKGROUND INFORMATION

When producing pulp bales, there is created a long pulp web which passes a drying apparatus for drying. After passing through the drying apparatus, the pulp web continues on toward a scissors device, where the pulp web is cut into sheets.

U.S. Pat. No. 3,634,948 discloses a drying apparatus for paper webs, comprising jet boxes positioned between upper and lower turning rolls. This known jet box arrangement, however, has such a small drying capacity that in order to achieve satisfactory drying it is necessary to arrange the upper and lower turning rolls so that they can assist in the drying, functioning like drying cylinders. Of course, this is a very expensive solution.

This invention intends to eliminate the problems with known techniques and to provide a drying apparatus which is not only more effective than known types but due to its design is also more compact in a horizontal direction than the known types. This has been made possible by the fact that the method and the apparatus according to the invention is characterized by the steps and features, respectively, which are apparent from the claims.

SUMMARY OF THE INVENTION

The drying apparatus according to the invention is so designed that essentially all that portion of the pulp web which momentarily is between the upper and lower turning rolls is irradiated on both sides by heated air. Due to that fact the drying cylinders mentioned in the cited U.S. patent can be eliminated.

BRIEF DESCRIPTION OF THE DRAWINGS

A preferred embodiment of the invention shall be described more closely below with reference to the accompanying drawings.

DETAILED DESCRIPTION OF THE INVENTION

Figure 1:
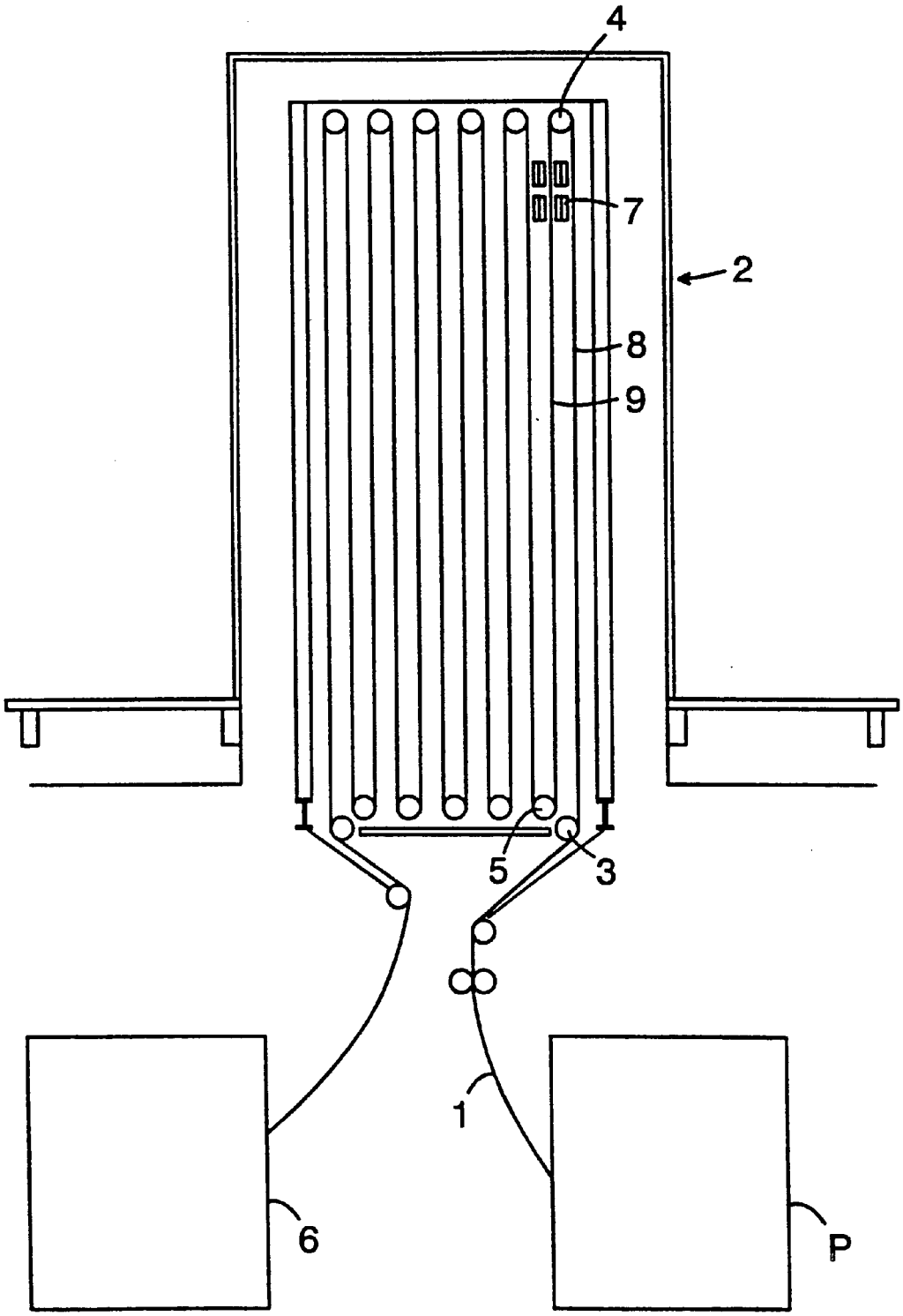
FIG. 1 shows a schematic over a pulp web plant in which the drying apparatus according to the invention is an integral part.

In FIG. 1 is shown how the pulp web 1, after having been produced in the schematically shown production plant P, comes into the drying apparatus 2 according to the invention at the portion 3, whereafter the pulp web goes essentially vertically up towards and rounds a first upper turning roll 4, turns downwards and goes essentially vertically down towards a first, lower turning roll 5, which is rounded by the pulp web, whereafter this one turns upwards again. In the illustrated embodiment the pulp web passes six upper turning rolls and five lower turning rolls before going further to a scissors device 6, where the pulp web is cut off to a uniform length for creating a pulp bale.

The purpose of the passage of the pulp web through the drying apparatus 2 is, as is apparent from the name, to dry the pulp web during passage through the same. For this reason, the drying apparatus 2 comprises a plurality of jet boxes 7, which are arranged in pairs in the areas between the pulp web parts 8, 9, going upwards and downwards. Preferably heated air is blown into these jet boxes in order to then be directed towards the passing pulp web parts 8, 9 through holes made in the portions of the jet boxes which are directed towards the pulp web parts.

Figure 2:
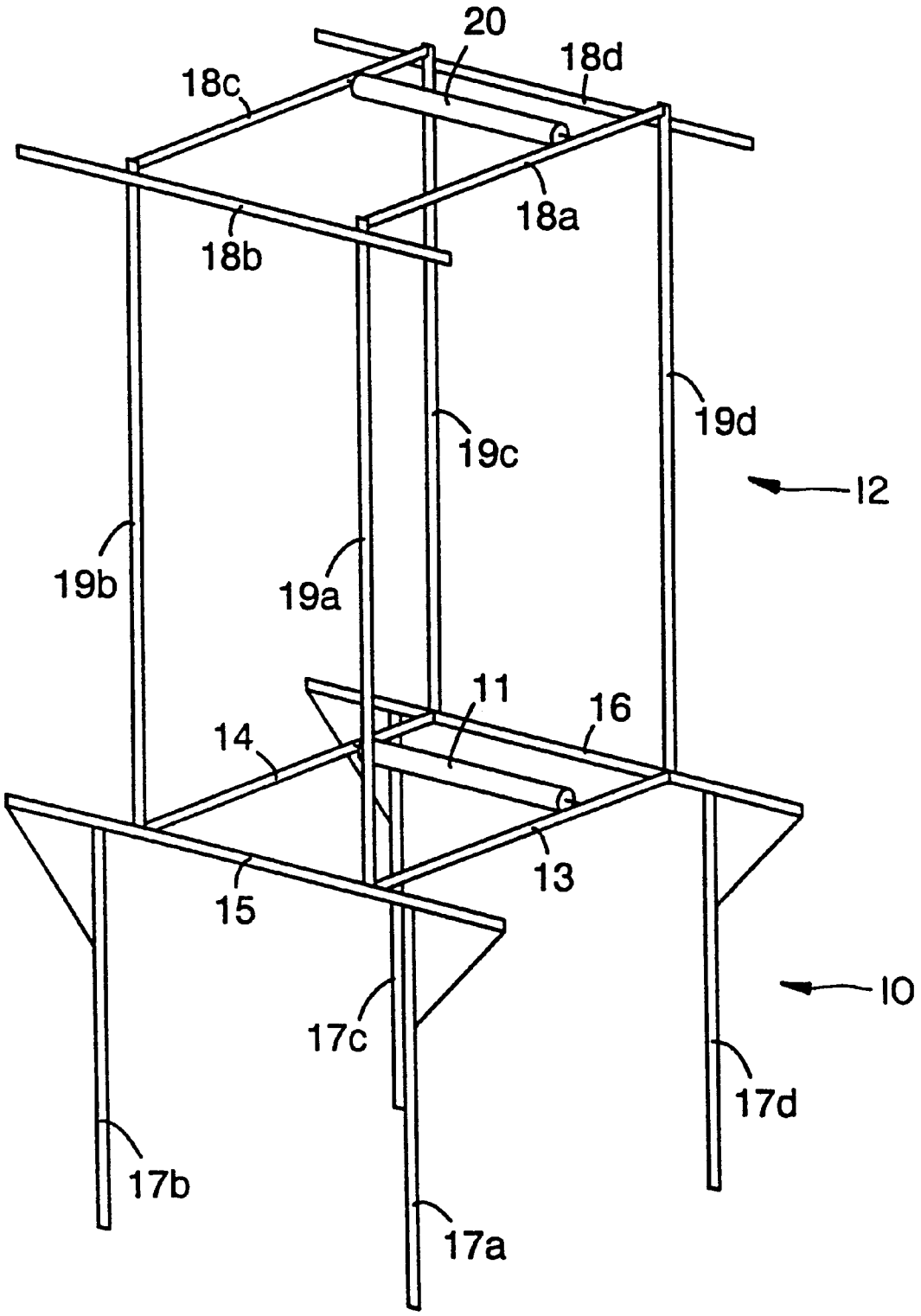
FIG. 2 shows a perspective view of an outer frame work for the drying apparatus according to the invention in which frame work the jet boxes and the turning rolls of the drying apparatus are intended to be arranged.

FIG. 2 shows the outer frame work carrying the drying apparatus according to the invention. The outer frame work comprises in part a lower frame part 10 which carries the lower turning rolls 11, and in part an upper frame part 12. In this connection the turning rolls 11 rest on two opposite, horizontal girders 13, 14 which together with two other opposite horizontal girders 15, 16 form a rectangle or a square. These horizontal girders 13–16 rest on four legs 17*a–d*, which in turn rest on a firm bedding.

The upper frame part 12, similarly to the lower frame part 10, comprises four girders 18*a–d*, which form a rectangle/square of essentially the same size as the lower rectangle/square. The upper frame part 12 further comprises four legs 19*a–d*, which rest on the lower frame part 10. The upper rectangle/square, the lower rectangle/square and the legs 19*a–d* together form a standing parallelepiped within which the pulp web parts, going upwards and downwards, are intended to move during the drying procedure.

The upper turning rolls 20 are arranged on the two opposite girders 18*a, c*, whereby the rolls are carried by the girders. The mentioned arrangement means that the upper and the lower turning rolls are fixed to the outer frame work and due to that fact are fixed in relation to the bedding.

Figure 3:
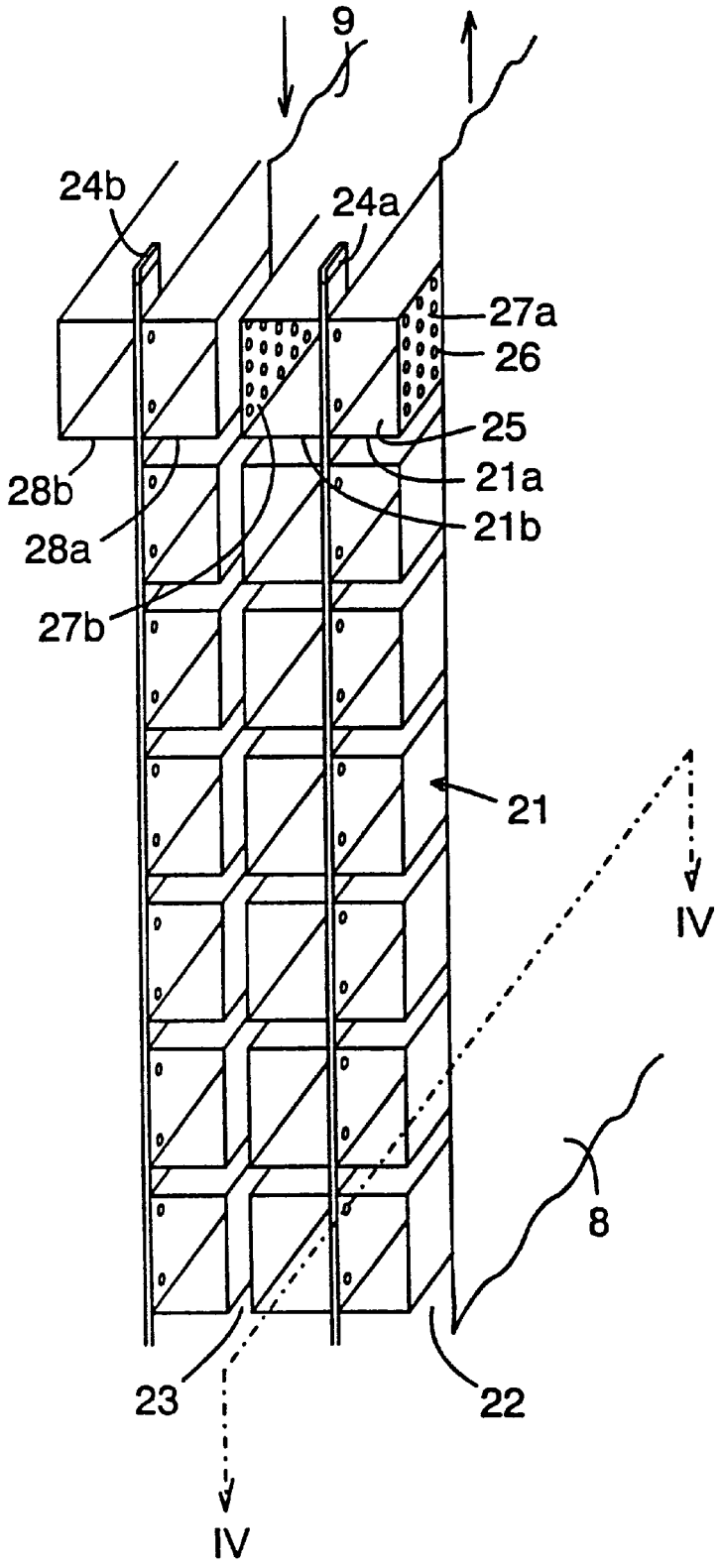
FIG. 3 shows an embodiment of a jet box arrangement.

FIG. 3 shows the arrangement with the jet boxes more closely. Each jet box 21 has an essentially parallelepipedic design with a narrowing, farther end portion, and has an essentially horizontal extension. In this connection, the jet boxes are arranged in pairs parallel with each other within the mentioned parallelepiped, which is formed by the area within the upper and lower rectangles/squares and the upper frame legs 19*a–d*. Due to that fact the jet boxes are arranged in pairs both laterally and under each other in the mentioned parallelepiped the pairs of jet boxes form parallel piles. In this connection there are created spaces 22, 23 between two piles of jet box pairs, which piles are arranged beside each other, the pulp web being intended to be brought essentially vertically upwards in a first space 22 and essentially vertically downwards in a second, adjacent space 23.

The jet boxes are suspended in the two upper horizontal girders 18*a, c* by means, 24*a, b*, of which only are shown in FIG. 3. According to the shown and preferred embodiment, the mentioned means is arranged between two adjacent jet boxes 21*a, b*, which accordingly are arranged in pairs from top to bottom within the mentioned parallelepiped. Due to that arrangement, the drying apparatus like a steam-boiler can expand from the top to its bottom.

Figure 4:
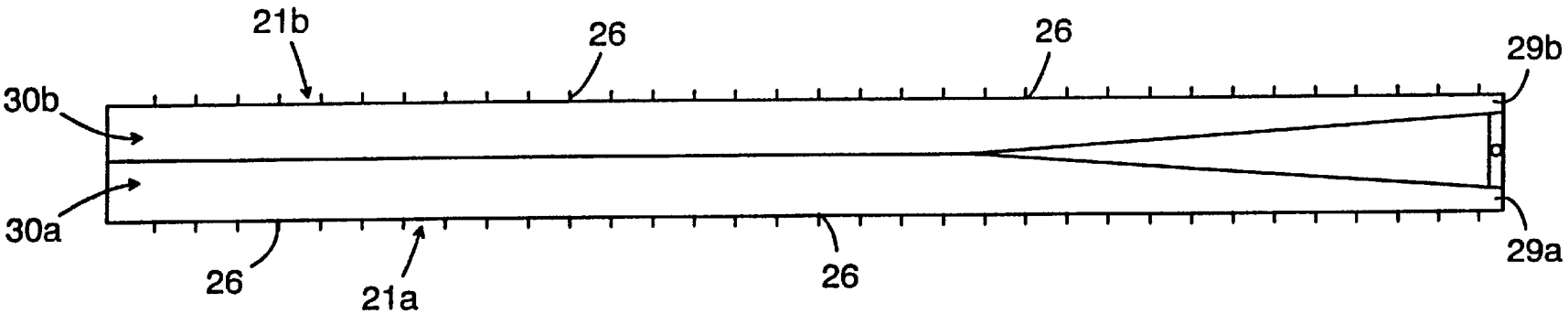
FIG. 4 shows a jet box couple seen in the direction of the arrows IV—IV in FIG. 3.

In FIG. 4 a jet box couple 21*a, b* is shown more closely. Each jet box has a narrowing, farther end portion 29*a, b* which is closed. The heated air is intended to be introduced into a respective box at the arrows 30*a, b*, and be taken out of the same via the holes 26.

For drying the pulp web, preferably heated air is blown into the jet boxes 21 by a not shown fan system through the openings 25, and further out from the boxes through holes 26 arranged in the sidewalls 27*a, b* of the jet boxes directed towards the pulp web parts. After having passed the jet boxes, the cooled air is sucked by the fan system through a not shown heating device whereinafter the air is blown into the jet boxes again.

The parts 8, 9 of the pulp web, going upwards and downwards are intended, as has been mentioned, to move between the jet boxes 21*a, b*; 28*a, b*, arranged in pairs laterally. Due to the fact that the movement of the pulp web parts, 8, 9 is essentially vertical through the drying apparatus, the distance between the jet boxes, arranged in pairs laterally, can be as small as about 30 mm. This fact means that the drying of the pulp web can be made by means of a variable air flow, which means a significant cost savings with respect of the cost of electricity in comparison with the costs associated with horizontal drying apparatuses, i.e. apparatuses where the paper web moves essentially horizontally through the same. In such apparatuses, the airflow through the jet boxes has to be at a maximum in order to sufficiently dry the pulp web transport between the jet boxes.

Another important advantage with the vertical drying apparatus according to the invention compared with a horizontal drying apparatus is that it is much simpler to clean the apparatus when the pulp web breaks, because the pulp web, when torn off, falls very easily out of the vertical drying apparatus.

When the pulp web comes into the drying apparatus it is very moist, but as it passes the different jet boxes there is a drying of the pulp web so that its moistness is reduced. Due to that fact the pulp web shrinks about 1%, there is a difference in velocity between the first and last turning roll. In order to eliminate the problems that this velocity difference can bring about each upper turning roll is provided with a so called visco coupling.

In the above text, the expression "pile" has been used. While pile in this connection is meant to convey a number of jet boxes arranged along an essentially vertical line, it is to be understood that the jet boxes are not necessarily in contact with each other.

In the text, the expression "girder" has also been used. One skilled in the art will readily recognize that instead of girders, pipes and rods may be used.

While the invention has been described in connection with what is presently considered to be the preferred embodiment, it is to be understood that the invention is not to be limited by the disclosed embodiment, but on the contrary, is intended to cover various modificating and equivalent arrangements within the spirit and scope of the invention, as will be appreciated by those of skill in the art to which the invention pertains. Such modifications and variations are within the scope of the following claims.

I claim:

1. Apparatus for drying a pulp web, comprising:

a frame;

upper (4; 20) turning devices, positioned in the frame in an upper part of the apparatus;

lower (5; 11) turning devices, positioned in the frame in a lower part of the apparatus, wherein the upper and lower turning devices lead the pulp web (8; 9) upwards and downwards; and a plurality of jet boxes (7; 21) arranged in essentially vertical piles, and positioned such that the pulp web can pass between the piles of jet boxes; wherein each of the jet boxes defines a primary opening for introducing heated air into the jet boxes and a plurality of secondary openings in a side of the jet boxes for directing the heated air out of the jet boxes for drying the pulp web, the jet boxes being arranged so that both sides of the pulp web are irradiated with the heated air, the side of the jet boxes having the plurality of secondary openings being essentially flat, the jet boxes (7; 21) essentially occupying all of a space in a vertical direction between the upper (4:20) and the lower (5:11) turning devices;

wherein the jet boxes (7:21) are suspended in the frame in the upper part of the apparatus, and hang freely down from the upper part towards the lower part of the apparatus, whereby the jet boxes can expand in downward direction.

2. An apparatus according to claim 1, wherein that the jet boxes (7; 21) are arranged in pairs in a horizontal direction wherein adjacent pairs of jet boxes are spaced apart from each other, and arranged in pairs in a vertical direction in the vertical piles of jet boxes, the vertical piles being arranged so that spaces are defined between vertical piles of jet boxes, the pulp web being led essentially vertically upwards in a first space of the spaces and essentially vertically downwards in a second adjacent space of the spaces.

3. An apparatus according to claim 2, wherein, the lower part (10) of the frame is fixed in relation to a bedding and an upper part (12) of the frame is fastened on top of the lower part and fixed in relation to the lower part of the frame the lower and upper parts of the frame comprising four essentially horizontal girders (13–16; 18*a–d*) which together form a rectangular shape, the upper part of the frame device being arranged essentially straightly above the lower part of the frame device, the upper and lower parts and an area between these parts form a parallelepiped within which the pulp web moves during the drying process, two opposite girders (18*a, c*) in the upper part of the frame carry a plurality of upper turning rolls (20), whereas two opposite girders (13, 14) in the lower part of the frame carry a plurality of lower turning rolls (11), and wherein the jet boxes (21) are arranged beside each other within the mentioned parallelepiped both in the horizontal and in the vertical direction in such a way that essentially an entire space within the parallelepiped is filled, the jet boxes (21) being suspended in the upper part of the frame by means (24*a, b*), which cooperates with two (18*a, c*) of the horizontal girders in the upper part of the frame device.

4. An apparatus according to claim 3, wherein the lower part of the frame rests on legs (17*a–d*), which in its turn rest on a firm bedding, and wherein the upper part of the frame (18*a–d*) rests on the lower part (13–16) by means of legs (19*a–d*) in such a way that the upper and lower parts of the frame and the intermediate legs (19*a–d*) form the mentioned parallelepiped within which the pulp web moves.

5. An apparatus according to claim 1, wherein, the lower part (10) of the frame is fixed in relation to a bedding and an upper part (12) of the frame is fastened on top of the lower part and fixed in relation to the lower part of the frame, the lower and upper parts of the frame comprising four essentially horizontal girders (13–16; 18*a–d*) which together form a rectangular shape, the upper part of the frame being arranged essentially above the lower part of the frame, the upper and lower parts and an area between these parts form a parallelepiped within which the pulp web moves during the drying process, two opposite girders (18*a, c*) in the upper part of the frame carry a plurality of upper turning rolls (20), whereas two opposite girders (13, 14) in the lower part of the frame carry a plurality of lower turning rolls (11), and wherein the jet boxes (21) are arranged beside each other within the mentioned parallelepiped both in the horizontal and in the vertical direction in such a way that essentially an entire space within the parallelepiped is filled, the jet boxes (21) being suspended in the upper part of the frame by means (24*a, b*), which cooperate with two (18*a, c*) of the horizontal girders in the upper part of the frame device.

6. An apparatus according to claim 5, wherein the lower part of the frame rests on legs (17*a–d*), which in its turn rest on a firm bedding, and wherein the upper part of the frame (18*a–d*) rests on the lower part (13–16) by means of legs (19*a–d*) in such a way that the upper and lower parts of the frame and the intermediate legs (19*a–d*) form the mentioned parallelepiped within which the pulp web moves.

* * * * *